US010002593B2

(12) United States Patent
Hu

(10) Patent No.: US 10,002,593 B2
(45) Date of Patent: Jun. 19, 2018

(54) GUITAR CAPO APPLICABLE TO DIFFERENT KINDS OF GUITARS

(71) Applicant: Tao Hu, Guangdong (CN)

(72) Inventor: Tao Hu, Guangdong (CN)

( * ) Notice: Subject to any disclaimer, the term of this patent is extended or adjusted under 35 U.S.C. 154(b) by 0 days. days.

(21) Appl. No.: 15/616,932

(22) Filed: Jun. 8, 2017

(65) Prior Publication Data

US 2018/0033410 A1 Feb. 1, 2018

(30) Foreign Application Priority Data

Jul. 27, 2016 (CN) ..... 2016 2 0801537 U

(51) Int. Cl.
*G10D 3/04* (2006.01)

(52) U.S. Cl.
CPC ..... *G10D 3/043* (2013.01)

(58) Field of Classification Search
CPC ..... G10D 3/043
See application file for complete search history.

(56) References Cited

U.S. PATENT DOCUMENTS

| | | | | |
|---|---|---|---|---|
| 514,263 | A * | 2/1894 | Filstrup | G10D 3/043 84/318 |
| 2,604,805 | A * | 7/1952 | Haffner | G10D 3/043 24/569 |
| 5,117,723 | A * | 6/1992 | Veenschoten | G10D 3/043 84/318 |
| 2014/0013924 | A1* | 1/2014 | Campling | G10D 3/043 84/318 |
| 2018/0033410 | A1* | 2/2018 | Hu | G10D 3/043 |

* cited by examiner

*Primary Examiner* — Robert W Horn

(57) ABSTRACT

A guitar capo applicable to different kinds of guitars, having upper shell silica gel fixed onto an upper shell; lower shell silica gel fixed onto a lower shell; a groove provided at a center position of each of the upper shell silica gel and the lower shell silica gel; a raised platform positioned at a periphery of each groove; a connecting end of the upper shell sleeving a connecting end of the lower shell; the connecting ends of the upper shell and the lower shell connected and fixed via the double rivet; a spring mounted on the double rivet; an end of an arm of the lower shell connecting to the upper shell being connected with the screw. The upper shell silica gel is applicable to an acoustic guitar. The lower shell silica gel is applicable to a classical guitar.

8 Claims, 2 Drawing Sheets

GUITAR CAPO APPLICABLE TO DIFFERENT KINDS OF GUITARS

BACKGROUND OF THE INVENTION

The present invention relates to the technical field of string instruments, and more specifically relates to a guitar capo applicable to different kinds of guitars.

Guitar capo is one of the most commonly used devices for a guitar. A guitar capo can change the key of a song without changing the fingerings, and thus it is widely used by a musician playing a guitar.

Nowadays, guitar capos of various shapes and appearances are available, however, the same capo cannot be used in both a classical guitar and an acoustic guitar because the necks of these two kinds of guitars have different lengths and also different forms of curvature. Therefore, a specific capo for key adjustment must be used for each kind of guitar.

In view of the above, the capos now available in the market are not multifunctional as they can only either applicable to a classical guitar or an acoustic guitar. Two different capos must be used respectively with these two kinds of guitars.

BRIEF SUMMARY OF THE INVENTION

In view of the aforesaid disadvantages now present in the prior art, the present invention provides a guitar capo, which is applicable to different kinds of guitars, so that users are not required to change capo when they play different kinds of guitars. Hence, the guitar capo of the present invention has a very high practicability.

The present invention has the following technical scheme: A guitar capo applicable to different kinds of guitars, comprising an upper shell, upper shell silica gel, a spring, a double rivet, a screw, lower shell silica gel and a lower shell; the upper shell silica gel is fixed onto the upper shell by using glue; the lower shell silica gel is fixed onto the lower shell also by using glue; a groove is provided at a center position of each of the upper shell silica gel and the lower shell silica gel; a raised platform is positioned at a periphery of each groove; a connecting end of the upper shell sleeves a connecting end of the lower shell; the connecting end of the upper shell and the connecting end of the lower shell are connected and fixed via the double rivet; the spring is mounted on the double rivet; an end of an arm of the lower shell connecting to the upper shell is connected with the screw.

Preferably, the groove and the raised platform positioned thereon form an integral structure.

Preferably, the upper shell silica gel has a length of 57 cm and has a curved shape; curvature of the upper shell silica gel has a radius of curvature being 9.5 inches so as to be applicable to an acoustic guitar.

Preferably, the lower shell silica gel has a length of 63 cm and is flat and straight so as to be applicable to a classical guitar.

Preferably, the connecting end of the upper shell connecting to the lower shell is provided with an upper shell positioning hole.

Preferably, the connecting end of the lower shell connecting to the upper shell is provided with a lower shell positioning hole.

Preferably, the upper shell positioning hole and the lower shell positioning hole match with each other; two ends of the double rivet pass through the upper positioning hole and the lower positioning hole respectively.

Preferably, the arm of the lower shell connecting to the upper shell is provided with a screw hole; the screw passes through the screw hole to connect and fix with the lower shell.

According to the structure described above, the upper shell silica gel has a length of 57 cm and has a curved shape so as to be applicable to an acoustic guitar; the lower shell silica gel has a length of 63 cm and is flat and straight so as to be applicable to a classical guitar. Therefore, the present invention can act on the strings of both kinds of guitars to achieve key adjustment. Moreover, platforms are provided at the upper shell silica gel and the lower shell silica gel where the capo clips on the guitar and the guitar strings; positioning by means of such small surface areas facilitates fixing operation. The capo of the present invention is applicable to different kinds of guitars so that users are not required to change capo when playing different kinds of guitars. The present invention has a very high practicability. It has a simple structure and is convenient to use.

REFERENCES IN THE FIGURES

1: upper shell; 2: upper shell silica gel; 3: spring; 4: double rivet; 5: screw; 6: lower shell silica gel; 7: lower shell; 8: groove; 11: upper shell positioning hole; 71: lower shell positioning hole; 72: screw hole; 81: raised platform.

DETAILED DESCRIPTION OF THE INVENTION

The present invention is further described comprehensively and clearly with reference to the drawings of an embodiment. It should be noted that the embodiment described below is only one of the many possible embodiments. Any other embodiments which are obtainable by a person skilled in this field of art in accordance with the teachings of the embodiment disclosed below without any inventive effort required should also fall within the scope of protection of the present invention.

Figure 1:
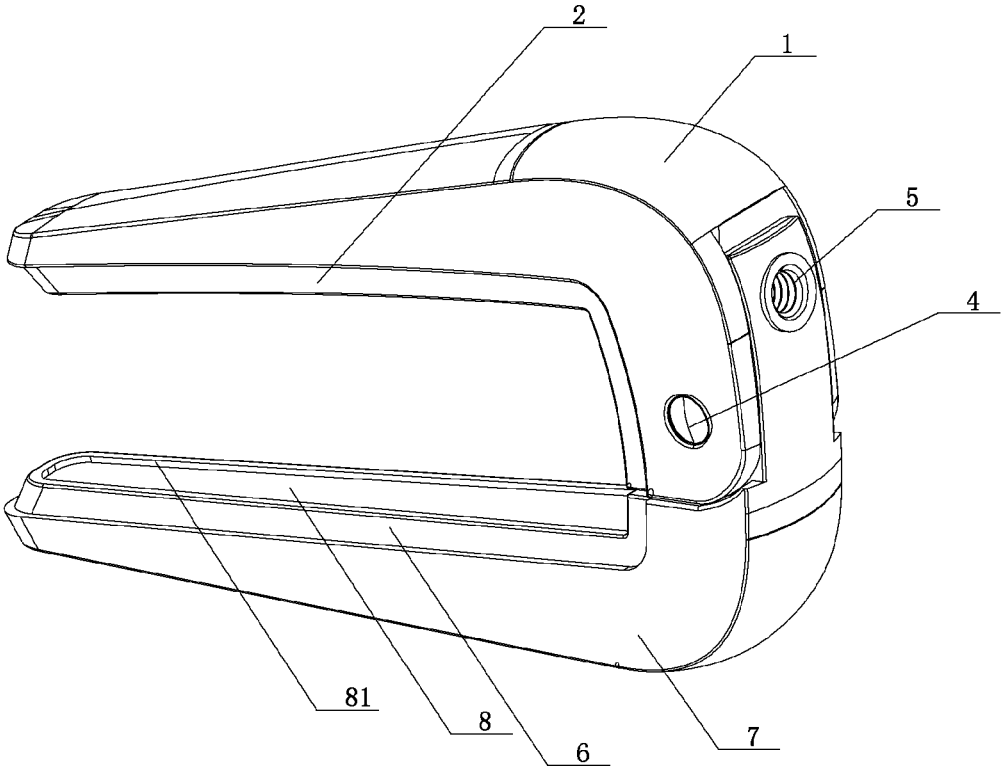
FIG. 1 is a structural diagram of the present invention.
Figure 2:
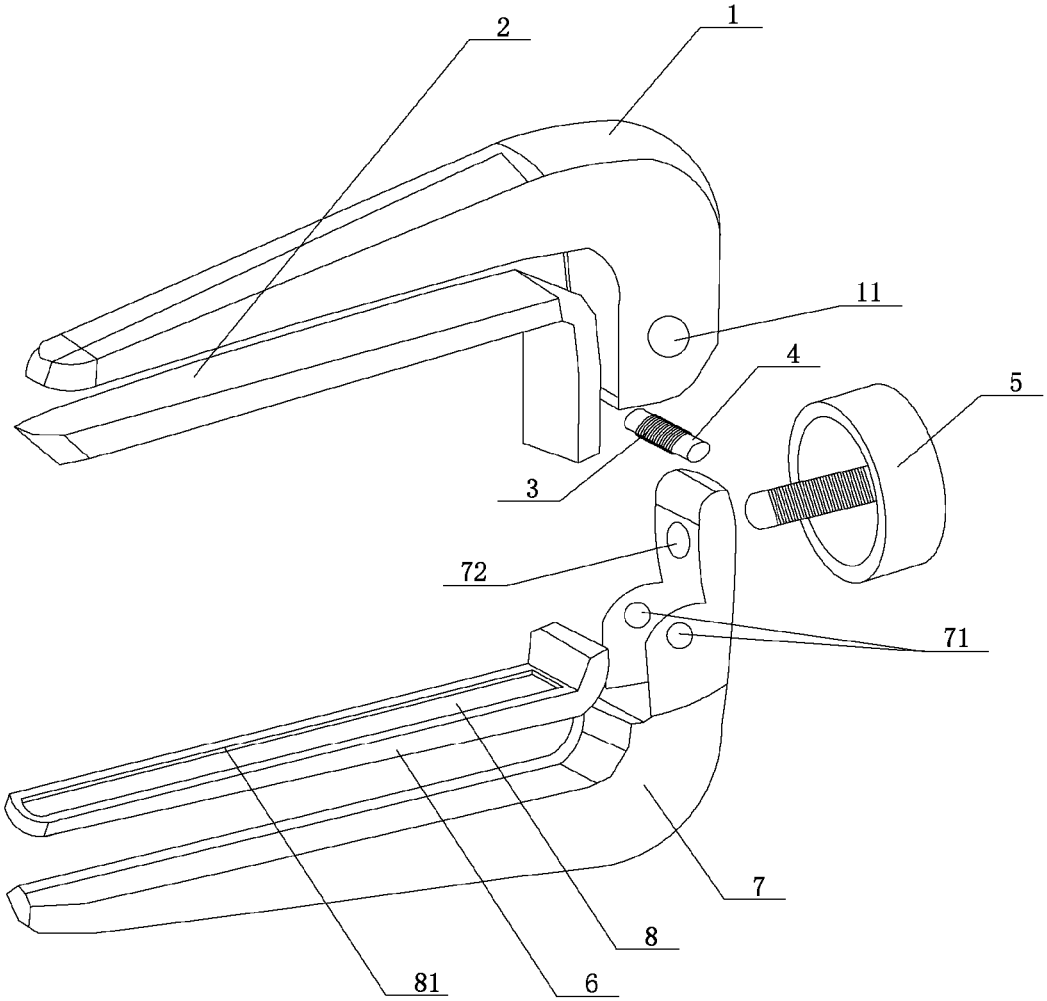
FIG. 2 is an exploded view showing the structure of the present invention.

As shown in FIGS. 1-2, the present invention comprises an upper shell 1, upper shell silica gel 2, a spring 3, a double rivet 4, a screw 5, lower shell silica gel 6 and a lower shell 7; the upper shell silica gel 2 is fixed onto the upper shell 1 by using glue; the lower shell silica gel 6 is fixed onto the lower shell 7 also by using glue; a groove 8 is provided at a center position of each of the upper shell silica gel 2 and the lower shell silica gel 6; a raised platform 81 is positioned at a periphery of each groove 8; a connecting end of the upper shell 1 sleeves a connecting end of the lower shell 7; the connecting end of the upper shell 1 and the connecting end of the lower shell 7 are connected and fixed via the double rivet 4; the spring 3 is mounted on the double rivet 4; an end of an arm of the lower shell 7 connecting to the upper shell 1 is connected with the screw 5.

The groove 8 and the raised platform 81 positioned thereon form an integral structure; the upper shell silica gel 2 has a length of 57 cm and has a curved shape; curvature of the upper shell silica gel 2 has a radius of curvature being 9.5 inches so as to be applicable to an acoustic guitar; the lower shell silica gel 6 has a length of 63 cm and is flat and straight so as to be applicable to a classical guitar; the connecting end of the upper shell 1 connecting to the lower shell 1 is provided with an upper shell positioning hole 11; the connecting end of the lower shell 7 connecting to the upper shell 1 is provided with a lower shell positioning hole 71; the upper shell positioning hole 11 and the lower shell positioning hole 71 match with each other; two ends of the double rivet 4 pass through the upper positioning hole 11 and the lower positioning hole 71 respectively; the arm of the lower shell 7 connecting to the upper shell 1 is provided with a screw hole 72; the screw 5 passes through the screw hole 72 to connect and fix with the lower shell 7.

In the above embodiment, the upper shell silica gel 2 has a length of 57 cm and has a curved shape so as to be applicable to an acoustic guitar; the lower shell silica gel 6 has a length of 63 cm and is flat and straight so as to be applicable to a classical guitar. Therefore, the present invention can act on the strings of both kinds of guitars to achieve key adjustment. Moreover, platforms 81 are provided at the upper shell silica gel and the lower shell silica gel where the capo clips on the guitar and the guitar strings; positioning by means of such small surface areas facilitates fixing operation. Also, the upper shell 1 and the lower shell 7 are fixed with each other via positioning holes and double rivet which form a movable supporting point; the spring 3 mounted on the double rivet 4 can exert spring force acting between the upper shell 1 and the lower shell 7 so that the upper shell 1 and the lower shell 7 can open freely, and then a left-side rotation of the screw 5 on the lower shell 7 can control the closing of the upper shell and the lower shell and the tightness of the closure, thereby protecting the guitar and the guitar strings. Left-side and right-side rotation of the screw 5 together with the extension and compression of the spring 3 constitute the opening and closing of the capo.

An embodiment of the present invention is shown and described above. However, a person skilled in this field of art may change, modify, alter or vary the present embodiment without deviating from the principle and essence of the present invention. The scope of protection of the present invention is defined according to the claims and their equivalence.

What is claimed is:

1. A guitar capo applicable to different kinds of guitars, comprising an upper shell, upper shell silica gel, a spring, a double rivet, a screw, lower shell silica gel and a lower shell; the upper shell silica gel is fixed onto the upper shell by using glue; the lower shell silica gel is fixed onto the lower shell also by using glue; a groove is provided at a center position of each of the upper shell silica gel and the lower shell silica gel; a raised platform is positioned at a periphery of each groove; a connecting end of the upper shell sleeves a connecting end of the lower shell; the connecting end of the upper shell and the connecting end of the lower shell are connected and fixed via the double rivet; the spring is mounted on the double rivet; an end of an arm of the lower shell connecting to the upper shell is connected with the screw.

2. The guitar capo as in claim 1, wherein the groove and the raised platform positioned thereon form an integral structure.

3. The guitar capo as in claim 1, wherein the upper shell silica gel has a length of 57 cm and has a curved shape; curvature of the upper shell silica gel has a radius of curvature being 9.5 inches.

4. The guitar capo as in claim 1, wherein the lower shell silica gel has a length of 63 cm and is flat and straight.

5. The guitar capo as in claim 1, wherein the connecting end of the upper shell connecting to the lower shell is provided with an upper shell positioning hole.

6. The guitar capo as in claim 1, wherein the connecting end of the lower shell connecting to the upper shell is provided with a lower shell positioning hole.

7. The guitar capo as in claim 1, wherein the upper shell positioning hole and the lower shell positioning hole match with each other; two ends of the double rivet pass through the upper positioning hole and the lower positioning hole respectively.

8. The guitar capo as in claim 1, wherein the arm of the lower shell connecting to the upper shell is provided with a screw hole; the screw passes through the screw hole to connect and fix with the lower shell.

* * * * *